US009938791B2

(12) United States Patent
Phythian et al.

(10) Patent No.: US 9,938,791 B2
(45) Date of Patent: Apr. 10, 2018

(54) ACTIVATION RING FOR WELLHEAD

(71) Applicant: Cameron International Corporation, Houston, TX (US)

(72) Inventors: Tim S. Phythian, Spring, TX (US); Clint D. Trimble, The Woodlands, TX (US)

(73) Assignee: Cameron International Corporation, Houston, TX (US)

( * ) Notice: Subject to any disclaimer, the term of this patent is extended or adjusted under 35 U.S.C. 154(b) by 185 days.

(21) Appl. No.: 14/586,463

(22) Filed: Dec. 30, 2014

(65) Prior Publication Data

US 2016/0186518 A1 Jun. 30, 2016

(51) Int. Cl.
*E21B 33/03* (2006.01)

(52) U.S. Cl.
CPC ..... *E21B 33/03* (2013.01)

(58) Field of Classification Search
CPC ..... E21B 33/03; E21B 33/04
See application file for complete search history.

(56) References Cited

U.S. PATENT DOCUMENTS 1,750,143 A * 3/1930 Wickersham ..... E21B 33/05 166/70
1,866,726 A * 7/1932 Santiago ..... E21B 33/04 166/70
3,119,449 A * 1/1964 Price ..... E21B 34/02 137/382
3,166,124 A * 1/1965 Johnson ..... E21B 33/064 137/454.2
3,208,349 A * 9/1965 Burnett ..... E21B 47/042 181/124
3,228,472 A * 1/1966 Rhoads, Jr. ..... E21B 41/02 166/64
3,378,066 A 4/1968 Otteman et al.
4,190,270 A * 2/1980 Vanderford ..... E21B 33/04 285/123.9
4,718,679 A * 1/1988 Vyvial ..... F16J 15/28 277/328
4,770,250 A 9/1988 Bridges et al.
4,886,121 A 12/1989 Demny et al.
5,158,326 A * 10/1992 Anderson ..... E21B 33/0422 285/123.9
6,125,939 A * 10/2000 Abreo, Jr. ..... E21B 33/043 166/208
6,302,211 B1 10/2001 Nelson et al.
6,598,673 B1 * 7/2003 Hosie ..... E21B 33/04 166/208
2010/0288503 A1 11/2010 Cuiper et al.
2011/0203810 A1 * 8/2011 Nguyen ..... E21B 33/03 166/387
2011/0232920 A1 9/2011 Nguyen et al.

* cited by examiner

*Primary Examiner* — Shane Bomar
(74) *Attorney, Agent, or Firm* — Chamberlain Hrdlicka

(57) ABSTRACT

An apparatus to define a shoulder within equipment includes a housing including a bore formed therethrough and a recess formed within an inner wall of the housing. The apparatus further includes an activation ring positionable within the recess and movable to extend, at least partially, into the bore of the housing to define a shoulder within the housing, and an actuator to move the activation ring with respect to the recess.

20 Claims, 5 Drawing Sheets

ACTIVATION RING FOR WELLHEAD

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead system through which the resource is extracted. These wellhead systems may include a wide variety of components, such as a high pressure wellhead housing and various casings, hangers, valves, fluid conduits, and the like, that control drilling and/or extraction operations.

As such, when drilling a well for oil or gas, a high pressure wellhead housing typically will be mounted at the upper end of the well and may be used to support one or more tubular strings extending into the well. In one example, a string of casing (or casing string) may be run into and installed within the well. A casing hanger located at the upper end of the string of casing lands on and is supported by a load shoulder in the high pressure wellhead housing. The load shoulder can be machined into the inner surface of the high pressure wellhead housing. Alternatively, the load shoulder can be a separate high strength ring that is installed into a groove in the high pressure wellhead housing, such as when the high pressure wellhead housing is initially manufactured. In both cases, the wellhead housing's inner diameter, and thus minimum diameter of the bore, decreases in a downward direction, with the smaller inner diameter located below the load shoulder.

The stepped diameter bore has a disadvantage. Drilling tools can be no larger than the minimum inner diameter located below the load shoulder. However, it is often desired to utilize a drill bit or tool that is larger than minimum inner diameter. For example, in a wellhead system that is used in containment of offshore shallow flow zones, it may be desirable to run a casing through a subsea high pressure housing having a minimum bore that is typically smaller than the outer diameter of the casing. The nominal seat of the high pressure wellhead housing (e.g., the insert load shoulder) must be removed or left off of the assembly prior to running a high pressure wellhead housing and then reinstalled subsequent to the installation of the casing. Accordingly, there is a demand to improve load shoulders for wellhead housings.

BRIEF DESCRIPTION OF THE DRAWINGS

For a detailed description of embodiments of the subject disclosure, reference will now be made to the accompanying drawings in which.

DETAILED DESCRIPTION

Figure 1A:
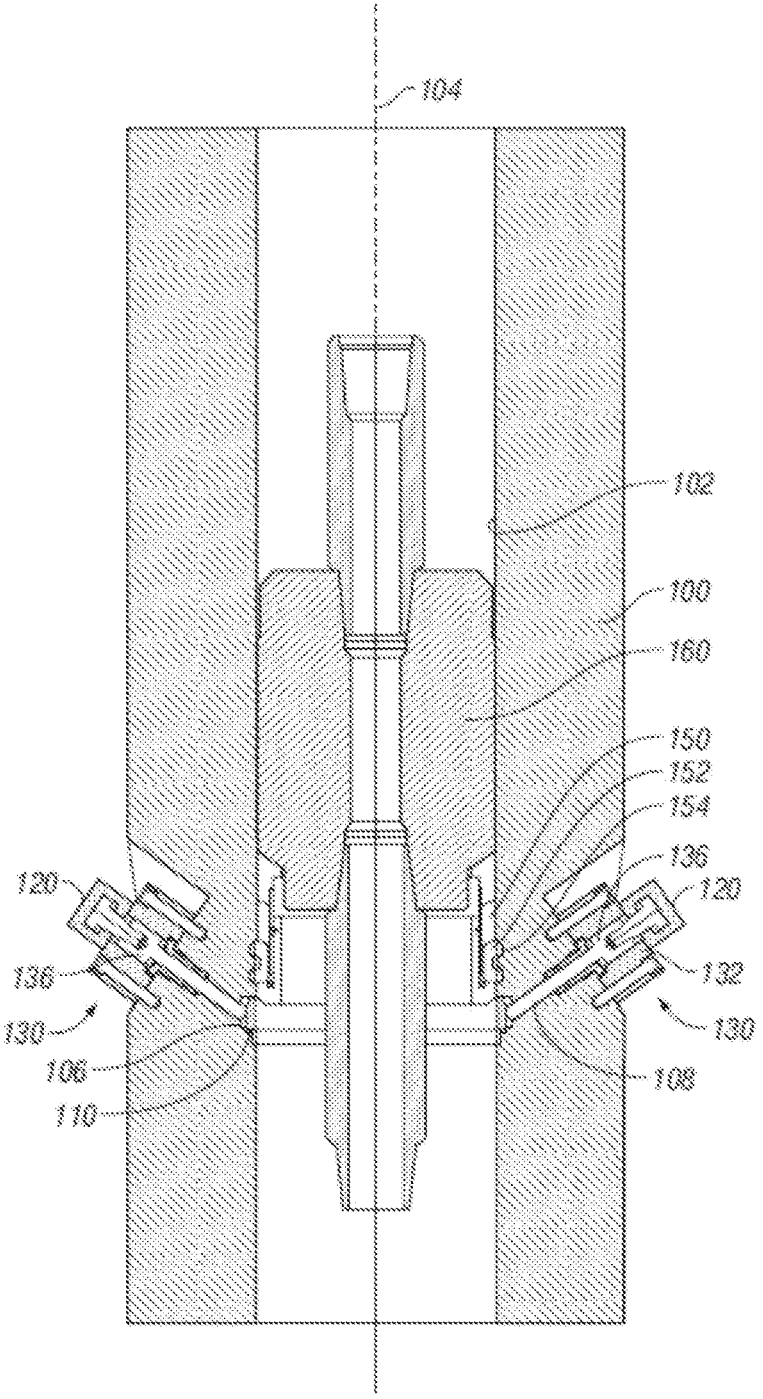
FIG. 1A shows a schematic, cross-sectional view of a system or apparatus used to define a shoulder within equipment in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. The embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be an illustration of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom,"

"above," "below," and variations of these terms is made for convenience, but does not require any particular orientation of the components.

Accordingly, disclosed herein are an apparatus and a system that maybe used to define a support structure (e.g., shoulder) within equipment, such as oil and gas equipment. The apparatus may include a spool, such as a high pressure wellhead housing, in which a bore is formed through the spool and a recess formed within the bore of the spool. The apparatus may further include an activation ring positionable within the recess and movable to extend, at least partially, into the bore of the spool to define a shoulder within the spool, and an actuator to move the activation ring with respect to the recess. For example, the activation ring may be movable between a retracted position and an extended position with respect to the recess: In the retracted position, the activation ring is fully retracted within the recess and does not impinge on the bore, but, in the extended position, the activation ring extends, at least partially, into the bore of the spool to define the shoulder within the spool.

A pin assembly may be connectable to the spool with the actuator operably coupled to the pin assembly such that the actuator moves the activation ring using the pin assembly. As such, the pin assembly may include a housing with a passage formed through the housing, and a pin movably positionable, at least partially, within the passage of the housing. The pin may be extendable through a passage formed within the spool to engage the activation ring, and the actuator may be operably coupled to the pin such that the actuator moves the activation ring with respect to the recess using the pin. An outer surface of the pin may be larger than an inner surface of the passage of the housing. The actuator may include a piston movably received within a cylinder with the piston of the actuator operably coupled to the pin. Further, a groove may be formed within the bore of the spool adjacent the recess with a retaining ring positionable within the groove to retain the activation ring within the recess.

Figure 1B:
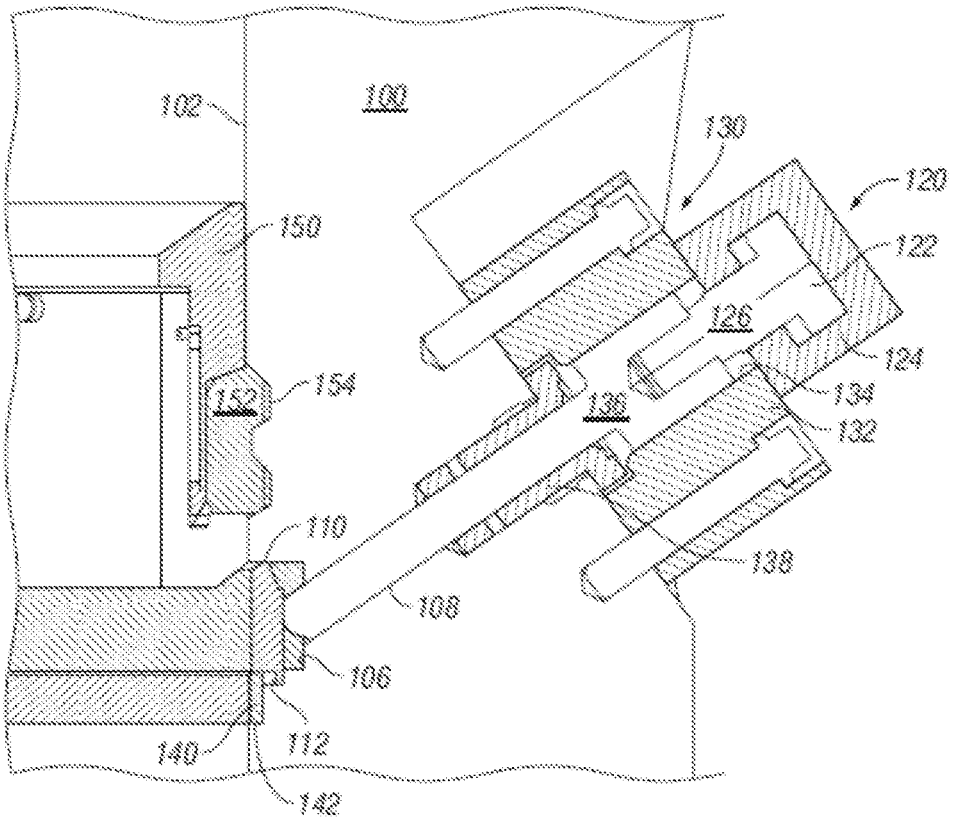
FIG. 1B is a detail view of FIG. 1A along Circle A-A.

FIGS. 1A and 1B provide multiple cross-sectional views of a system and an apparatus used to define a shoulder within equipment, such as oil and gas equipment, in accordance with one or more embodiments of the present disclosure. In particular, FIG. 1A shows a cross-sectional view of an exemplary spool 100 that has an activation ring 110, actuators 120, and pin assemblies 130, and FIG. 1B shows a detail view of the view shown in FIG. 1A along Circle A-A.

The spool 100 may be wellhead housing and/or any other type of equipment used to define, form, or otherwise include a shoulder within the spool 100. For example, the spool 100 may be a high pressure wellhead housing, and/or may be any other type of oil and gas equipment, in which the spool 100 may be used within surface and/or subsea applications and may be used within drilling and/or production applications. The spool 100 may include a bore 102 formed through and about an axis 104 of the spool 100. A recess 106 may be formed within the bore 102 and/or extend into an inner wall of the spool 100. The activation ring 110 may then be positioned within the recess 106 such that the activation ring 110 is movable within and with respect to the recess 106. In particular, the activation ring 110 may be movable within and respect to the recess 106 for the activation ring 110 to extend, at least partially, into the bore 102 and towards the axis 104 of the spool 100 to define a shoulder within the spool 100. The shoulder may be used for one or more components to land upon the shoulder within the spool 100. As such, the activation ring 110 may be movable between a retracted position and an extended position with respect to the recess 106 and/or the axis 104 of the spool 100. In the retracted position, the activation ring 110 may be retracted (e.g., fully retracted) into the recess 106 such that the activation ring 110 provides no restriction to the internal diameter of the bore 102 of the spool 100. In the extended position, the activation ring 110 extends, at least partially, from the recess 106 and into the bore 102 such that the activation ring 110 defines the shoulder within the bore 102 of the spool 100. Accordingly, an activation ring in accordance with the present disclosure may be a split ring, C-ring, segmented ring, a plurality of unconnected components, and/or any other type of ring or component that may be expandable and retractable to define a shoulder within a spool.

As mentioned above, one or more actuators 120 may be included to move the activation ring 110 within the recess 106 towards or away from the axis 104. In this embodiment, the activation ring 110 is controlled and actuated by the one or more actuators 120. For example, as shown, one or more pin assemblies 130 may be included and connected to the spool 100, with an actuator 120 operably coupled to each pin assembly 130 such that the actuator 120 moves the activation ring 110 using the pin assembly 130. As such, each pin assembly 130 included may have a corresponding actuator 120 operably coupled to the pin assembly 130 to operate the pin assembly 130 and move the activation ring 110 using the pin assembly 130. In an embodiment in which more than one pin assembly 130 is included, the pin assemblies 130 may be equally spaced from each other, such as equally spaced about the axis 104. For example, in an embodiment in which four pin assemblies 130 are included with the spool 100, each of the pin assemblies 130 may be positioned about 90 degrees away from each other with respect to the axis 104 of the spool 100. This may enable an equal distribution of force upon the activation ring 110 by the actuators 120.

The pin assembly 130, as shown in more detail in FIG. 1B, may include a housing 132 with a passage 134 formed through the housing 132. The housing 132 may be connected to the spool 100, such as through the use of one or more attachments mechanisms, such as a nut, bolt, screw, and/or any other attachment mechanism known in the art. A passage 108 may be formed within the spool 100 corresponding to each pin assembly 130, in which the passage 108 may extend from an exterior surface to the recess 106 of the spool 100 to enable the pin assembly 130 to engage the activation ring 110 in the recess 106. As such, the passage 134 of the housing 132 may be in alignment with the passage 108. The pin assembly 130 may further include a pin 136, in which the pin 136 may be movably positioned, at least partially, within the passage 134 of the housing 132. The pin 136 may also extend into and through the passage 108 of the spool 100 such that the pin 136 engages the activation ring 110. For example, the actuator 120 may be operably coupled to the pin 136 such that the actuator 120 moves the activation ring 110 within and with respect to the recess 106 using the pin 136.

An actuator in accordance with the present disclosure may be a hydraulic actuator, a pneumatic actuator, an electrical actuator, a mechanical actuator, and/or any other type of actuator known in the art, or any combination of these. In this embodiment, the actuator 120 may be a hydraulic actuator, in which the actuator 120 includes a piston 122 movably received within a cylinder 124. The piston 122 may be operably coupled to the pin 136, such as by including a piston rod 126 that connects (e.g., threadingly engage or connect) to the pin 136 to the piston 122. As such, hydraulic pressure may be used to move the piston 122 within the cylinder 124, thereby moving the pin 136 and the activation ring 110 between the extended position and the retracted position.

In this embodiment, to be able to minimize an outer diameter for the spool 100 with the pin assembly 130 and actuator 120 connected thereto, the pin assembly 130 may be positioned at an angle with respect to the spool 100. For example, the pin 136 of the pin assembly 130 may extend at an angle with respect to a direction that is perpendicular with respect to the axis 104 of the spool 100. In such an embodiment, the pin 136 may then slidingly engage the activation ring 110 such that the pin 136 may slide against a back surface of the activation ring 110 when moving the activation ring 110.

One or more seals or seal assemblies may be used to seal the engagement between the actuator, the pin assembly, and/or the spool. For example, with reference to FIG. 1B, a seal assembly 138, such as a seal carrier, stem packer, and/or any other type of seal or seal assembly, may be positioned between the pin assembly 130 and the spool 100. In particular, a seal assembly 138 that includes or carries one or more seals may be positioned, at least partially, within the passage 108 of the spool 100. The pin 136 of the pin assembly 130 may then extend through the seal assembly 138 such that the seal assembly 138 is able to seal between the pin 136 and the passage 108 of the spool 100. As such, the seal assembly 138 may threadingly engage or connect with the passage 108 of the spool 100.

In one or more embodiments, a retaining ring 140 may be used to retain the activation ring 110 within the recess 106. For example, a groove 142 may be formed within the bore 102 and/or extend into the spool 100, in which the groove 142 may be adjacent the recess 106. The retaining ring 140 may be positioned within the groove 142 to engage and retain the activation ring 110 within the recess 106. In particular, a notch 112 may be formed within the activation ring 110. The retaining ring 140 may then be positioned, at least partially, within and/or slidingly engage the notch 112 of the activation ring 110. As such, in one or more embodiments, the retaining ring 140 may remain stationary as the activation ring 110 moves within the recess 106. Thus, the retaining ring 140 can limit the travel of the activation ring 110.

As discussed above, the activation ring 110 may be extendable into the bore 102 of the spool 100 such as to form and define a shoulder within the spool 100, in which one or more components may then land upon the shoulder within the spool 100. As such, with respect to FIGS. 1A and 1B, a load shoulder sleeve 150 may be introduced into the spool 100 and landed upon the activation ring 110 when extended into and defining a shoulder within the bore 102 of the spool 100. Upon landing, the load shoulder sleeve 150 may then have one or more dogs 152 that expand into and engage one or more corresponding recesses 154 formed within the bore 102 of the spool 100. In such an embodiment, the load shoulder sleeve 150 may have a higher strength capacity than that of the activation ring 110, in which one or more components may then land upon the load shoulder sleeve 150. For example, as shown in FIG. 1A, an expandable packing tool 160 and/or blowout preventer tester may land upon the load shoulder sleeve 150. The spool 100 may therefore be installed below a blowout preventer or a blowout preventer stack, such as when testing one or more blowout preventers. Further, those having ordinary skill in the art will appreciate that a load shoulder sleeve 150 may not be used or necessary, thereby landing the expandable packing tool 160 directly upon the activation ring 110. Additionally or alternatively, other components, such as a tubing hanger, may be landable upon the shoulder when the activation ring 110 is extended into the bore 102 of the spool 100.

Figure 2A:
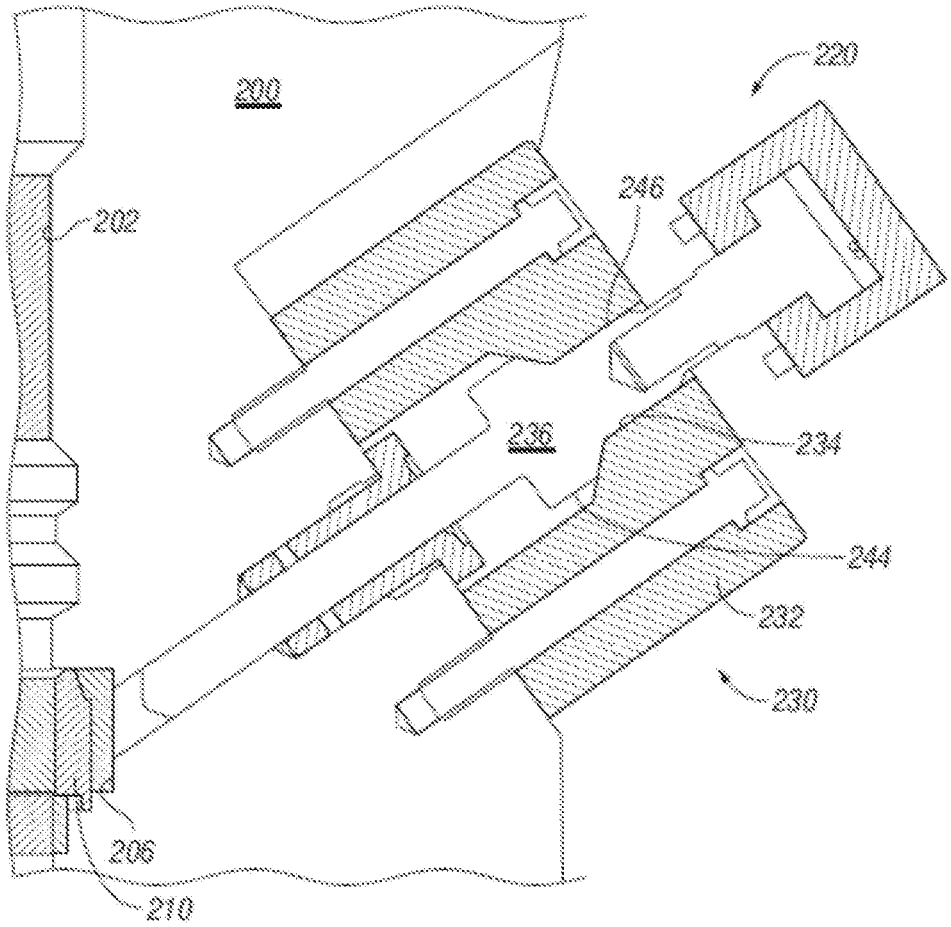
FIG. 2A shows a schematic, cross-sectional view of an actuator when connecting to a pin assembly in accordance with one or more embodiments of the present disclosure.
Figure 2B:
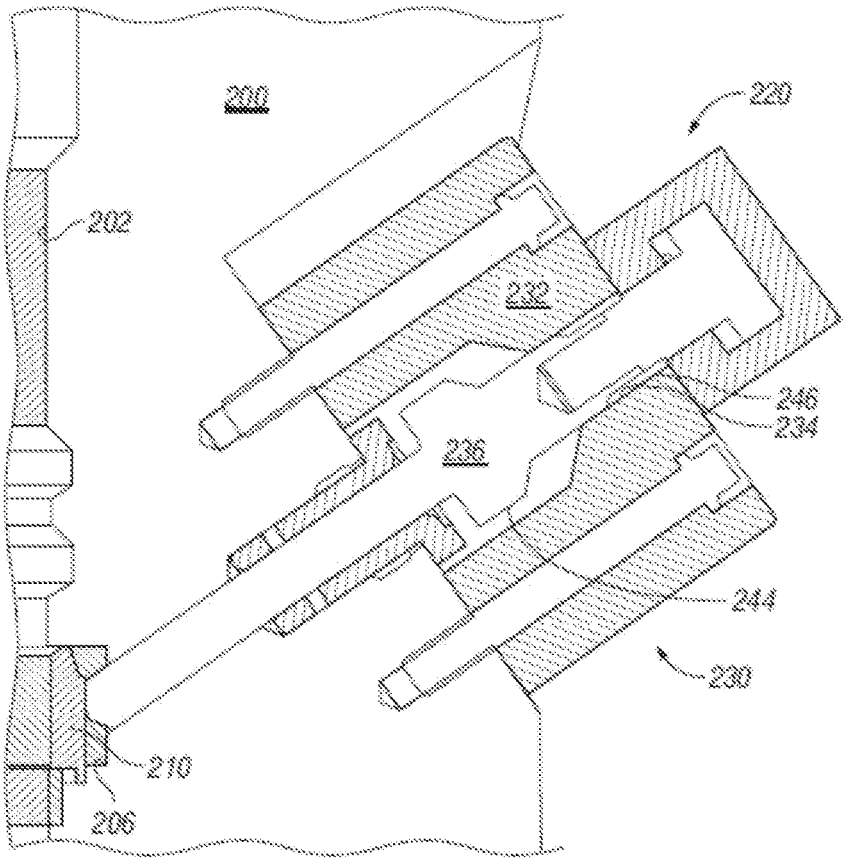
FIG. 2B shows an activation ring, an actuator, and a pin assembly in a retracted position in accordance with one or more embodiments of the present disclosure.
Figure 2C:
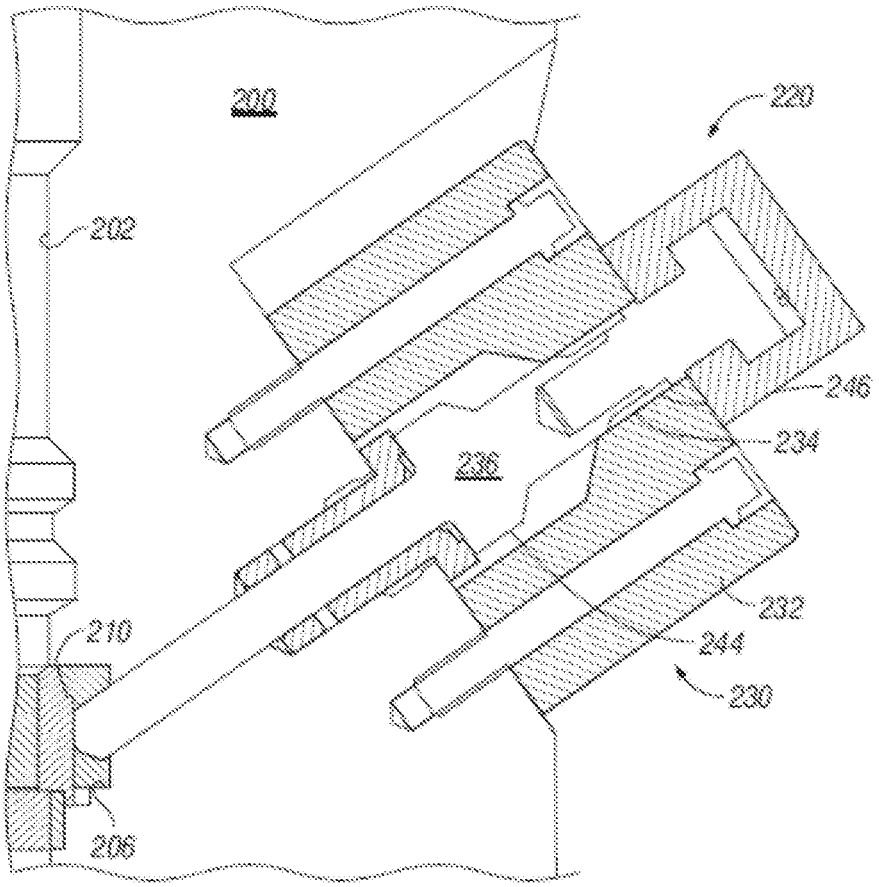
FIG. 2C shows the activation ring, the actuator, and the pin assembly in an extended position in accordance with one or more embodiments of the present disclosure.

Referring now to FIGS. 2A-2C, multiple cross-sectional views of a pin assembly 230 in accordance with one or more embodiments of the present disclosure are shown. The pin assembly 230 may have an actuator 220 operably coupled to the pin assembly 230, and the pin assembly 230 may be connected to a spool 200. As such, the actuator 220 may be used to move an activation ring 210 with respect to a recess 206 formed within a bore 202 of the spool 200.

FIG. 2A shows the actuator 220 when connecting to the pin assembly 230. FIG. 2B shows the activation ring 210, the actuator 220, and/or the pin assembly 230 in the retracted position, and FIG. 2C shows the activation ring 210, the actuator 220, and/or the pin assembly 230 in the extended position. As such, in the retracted position, the activation ring 210 may be retracted (e.g., fully retracted) into the recess 206 such that the activation ring 210 provides no restriction to the internal diameter of the bore 202 of the spool 200. In the extended position, the activation ring 210 extends, at least partially, from the recess 206 and into the bore 202 such that the activation ring 210 defines the shoulder within the bore 202 of the spool 200, where the shoulder can support a hanger. In certain embodiments, the activation ring 210 can be replaced to correspond with a support surface on the hanger. This allows the spool 200 to accommodate tools or hangers with different support surfaces or different supporting requirements In one or more embodiments, the activation ring 210 may be biased radially outward such that the activation ring 210 is biased from the extended position to the retracted position. Additionally or alternatively, the activation ring 210 may be connected to a pin 236 of the pin assembly 230, such as through a button and slot engagement, in which the pin 236 may move the activation ring 210 as the pin 236 moves between the extended position and the retracted position.

Further, as with the above embodiments, the pin assembly 230 may include a housing 232 with a passage 234 formed through the housing 232. The pin assembly 230 may further include a pin 236, in which the pin 236 may be movably positioned, at least partially, within the passage 234 of the housing 232. Accordingly, in this embodiment, an outer surface 244 of the pin 236 may be larger than an inner surface 246 of the passage 234 of the housing 232. In particular, a greatest outer diameter of the pin 236 may be larger than a smallest inner diameter of the passage 234 of the housing 232. This may enable the pin 236 to be retained within the housing 232, even in the event that an actuator 220 is not coupled to the pin 236 of the pin assembly 230. As such, the actuator 220 may be replaced without having to disconnect the pin assembly 230 from the spool 200.

Although the present invention has been described with respect to specific details, it is not intended that such details should be regarded as limitations on the scope of the invention, except to the extent that they are included in the accompanying claims.

What is claimed is:

1. A housing used to define a shoulder, the housing comprising:

an innermost bore formed within the housing and a recess formed within an inner wall of the housing;

an activation ring positionable within the recess and movable between a retracted position and an extended position with respect to the recess such that, in the retracted position, the activation ring is fully retracted within the recess and, in the extended position, the activation ring extends, at least partially, into the innermost bore of the housing to define the shoulder within the housing; and an actuator to move the activation ring with respect to the recess.

2. The housing of claim 1, further comprising a pin assembly connectable to the housing with the actuator operably coupled to the pin assembly such that the actuator is capable of moving the activation ring using the pin assembly.

3. The housing of claim 2, wherein the pin assembly comprises:

a pin assembly housing including a pin assembly passage formed therethrough; and a pin movably positionable, at least partially, within the pin assembly passage of the pin assembly housing;

the pin extendable through a passage formed within the housing to engage the activation ring; and the actuator operably coupled to the pin such that the actuator moves the activation ring with respect to the recess using the pin.

4. The housing of claim 3, wherein a largest outer diameter of the pin is larger than a smallest inner diameter of the pin assembly passage of the pin assembly housing.

5. The housing of claim 3, wherein the actuator comprises a piston movably received within a cylinder with the piston of the actuator operably coupled to the pin.

6. The housing of claim 3, further comprising a seal positioned between the pin and the passage of the housing.

7. The housing of claim 3, wherein the pin extends at an angle with respect to a direction perpendicular to an axis of the innermost bore of the housing, and wherein the pin slidingly engages the activation ring.

8. The housing of claim 1, wherein the activation ring comprises a split ring.

9. The housing of claim 1, wherein the housing comprises a high pressure wellhead housing.

10. The housing of claim 1, wherein the actuator comprises at least one of a hydraulic actuator, a pneumatic actuator, an electrical actuator, and a mechanical actuator.

11. The housing of claim 1, further comprising:

a groove formed within the inner wall of the housing adjacent the recess; and a retaining ring positionable within the groove to retain the activation ring within the recess.

12. A high pressure wellhead housing used to define a shoulder, the high pressure wellhead housing comprising:

an innermost bore formed within the high pressure wellhead housing and a recess formed within an inner wall of the high pressure wellhead housing;

an activation ring positionable within the recess and movable to extend, at least partially, into the innermost bore of the high pressure wellhead housing to define the shoulder within the high pressure wellhead housing;

an actuator to move the activation ring with respect to the recess; and a pin assembly connectable to the high pressure wellhead housing with the actuator operably coupled to the pin assembly such that the actuator moves the activation ring using the pin assembly.

13. The high pressure wellhead housing of claim 12, wherein:

the actuator comprises more than one actuator;

the pin assembly comprises more than one pin assembly; and each of the pin assemblies is operably coupled to a corresponding actuator such that each actuator is capable of moving the activation ring using a corresponding pin assembly.

14. The high pressure wellhead housing of claim 12, wherein the pin assembly comprises:

a pin assembly housing including a pin assembly passage formed therethrough; and a pin movably positionable, at least partially, within the pin assembly passage of the pin assembly housing;

the pin extendable through a passage formed within the high pressure wellhead housing to engage the activation ring; and the actuator operably coupled to the pin such that the actuator moves the activation ring with respect to the recess using the pin.

15. The high pressure wellhead housing of claim 14, wherein a largest outer diameter of the pin is larger than a smallest inner diameter of the pin assembly passage of the pin assembly housing.

16. The high pressure wellhead housing of claim 14, further comprising a seal positioned between the pin and the passage of the high pressure wellhead housing.

17. The high pressure wellhead housing of claim 12, wherein the activation ring is movable between a retracted position and an extended position with respect to the recess such that, in the retracted position, the activation ring is fully retracted within the recess and, in the extended position, the activation ring extends, at least partially, into the innermost bore of the high pressure wellhead housing to define the shoulder within the high pressure wellhead housing.

18. The high pressure wellhead housing of claim 12, further comprising a groove formed within the inner wall of the high pressure wellhead housing adjacent the recess with a retaining ring positionable within the groove to retain the activation ring within the recess.

19. The high pressure wellhead housing of claim 12, further comprising a tubing hanger landable upon the shoulder when the activation ring is extended into the innermost bore of the high pressure wellhead housing.

20. A wellhead assembly, comprising:

a spool with an internal innermost bore extending axially therethrough and a recessed portion extending radially outward from the innermost bore;

a positionable shoulder configured to move from an inactive position to an active position and from the active on to the inactive position such that, in the active position, the shoulder is at least partially disposed in the innermost bore, and in the inactive position, the shoulder is not disposed in the innermost bore and is fully disposed in the recessed portion; and a mechanism configured to move the shoulder from the active position to the inactive position.

* * * * *